US009757836B2

(12) United States Patent
Van Der Veen

(10) Patent No.: US 9,757,836 B2
(45) Date of Patent: Sep. 12, 2017

(54) GRINDING APPARATUS

(71) Applicant: Veen Holdings Pty Ltd, Bayswater North (AU)

(72) Inventor: Tim Van Der Veen, Bayswater North (AU)

(73) Assignee: Veen Holdings Pty. Ltd., Bayswater North (AU)

( * ) Notice: Subject to any disclaimer, the term of this patent is extended or adjusted under 35 U.S.C. 154(b) by 0 days.

(21) Appl. No.: 14/175,101

(22) Filed: Feb. 7, 2014

(65) Prior Publication Data

US 2014/0154959 A1 Jun. 5, 2014

Related U.S. Application Data

(63) Continuation of application No. PCT/AU2012/000884, filed on Jul. 25, 2012.

(30) Foreign Application Priority Data

Aug. 8, 2011 (AU) ..... 2011903170

(51) Int. Cl.

| | |
|---|---|
| ***B24B 7/18*** | (2006.01) |
| ***B24B 41/047*** | (2006.01) |
| ***B24B 7/00*** | (2006.01) |
| ***B24B 27/00*** | (2006.01) |

(52) U.S. Cl.

CPC ..... *B24B 7/18* (2013.01); *B24B 7/005* (2013.01); *B24B 7/186* (2013.01); *B24B 27/0076* (2013.01); *B24B 41/047* (2013.01)

(58) Field of Classification Search

CPC .. B24B 7/18; B24B 41/00; B24B 7/00; B24B 7/005; A47L 11/02

USPC ..... 451/353, 350

See application file for complete search history.

(56) References Cited

U.S. PATENT DOCUMENTS 3,277,511 A * 10/1966 Little et al. ..... 15/320
4,317,252 A * 3/1982 Knowlton ..... A47L 11/29 15/320
4,490,873 A * 1/1985 Stratton ..... 15/320

(Continued)

FOREIGN PATENT DOCUMENTS

| | | | |
|---|---|---|---|
| EP | 705558 | A1 | 4/1996 |
| WO | WO9514140 | A1 | 5/1995 |
| WO | WO03076131 | A1 | 9/2003 |

OTHER PUBLICATIONS

International Search Report for International Application PCT/AU2012/000884, mailed Aug. 9, 2012.

*Primary Examiner* — Robert Rose
(74) *Attorney, Agent, or Firm* — Fish & Richardson P.C.

(57) ABSTRACT

A grinding apparatus for grinding a floor, the apparatus comprising a body having a travelling mechanism which enables the body to travel across a floor while the apparatus is grinding; a first grinding head incorporating at least one grinding tool and having an operable configuration in which the first grinding head is able to grind a first floor portion; and a second grinding head incorporating at least one grinding tool and having an operable configuration in which the second grinding head is able to grind a second floor portion; wherein the first and second grinding heads are mountable to the body whereby their positions relative to the body are able to be varied.

19 Claims, 6 Drawing Sheets

(56) References Cited

U.S. PATENT DOCUMENTS

| | | | | | |
|---|---|---|---|---|---|
| 4,783,872 | A * | 11/1988 | Burhoe | A47L 11/162 | 15/49.1 |
| 5,742,966 | A * | 4/1998 | Tono | 15/49.1 | |
| 6,023,813 | A * | 2/2000 | Thatcher | A47L 11/16 | 15/320 |
| D442,288 | S * | 5/2001 | Bloor | D32/25 | |
| 8,684,796 | B2 * | 4/2014 | McCutchen et al. | 451/57 | |
| 2007/0157417 | A1 * | 7/2007 | O'Hara | A47L 11/30 | 15/320 |
| 2009/0023369 | A1 * | 1/2009 | Thysell | B24B 41/047 | 451/350 |
| 2010/0197210 | A1 * | 8/2010 | Goldberg | B24B 7/186 | 451/353 |

* cited by examiner

GRINDING APPARATUS

TECHNICAL FIELD

The present disclosure relates to a grinding apparatus for grinding a floor. It is especially related to an apparatus for grinding and polishing concrete floors and surfaces.

BACKGROUND

Grinders are used to grind and polish floor surfaces including wooden and concrete floors. Typically the apparatus comprises a grinding head that is mounted to the chassis of the apparatus which is pushed or guided (where the apparatus has a motor driven wheel system) over the floor surface by an operator.

For large commercial floor surfaces, the task of grinding and polishing surfaces can be quite laborious using such a grinding apparatus. In these situations a number of grinding apparatuses might be used to reduce the time taken to carry out the task, although this requires multiple operators and multiple grinders with the associated increased cost. Alternatively, larger grinders with multiple grinding heads that cover a much bigger surface area can be used. However, in some cases the ability to use such large grinders may be limited by the size of the entrance to the space where the floor requires grinding. Furthermore, the larger grinders are less able to grind into corners and other restricted spaces and thus it would still be necessary to have additional smaller equipment available to complete the grinding task. A further problem with using larger grinders is that, due to their size, they require larger vehicles to transport them to site.

SUMMARY OF THE DISCLOSURE

The present disclosure provides a grinding apparatus for grinding a floor, the apparatus comprising:

- a body having a travelling mechanism which enables the body to travel across a floor while the apparatus is grinding;
- a first grinding head incorporating at least one grinding tool and having an operable configuration in which the first grinding head is able to grind a first floor portion; and
- a second grinding head incorporating at least one grinding tool and having an operable configuration in which the second grinding head is able to grind a second floor portion;
- wherein the first and second grinding heads are mountable to the body whereby their positions relative to the body are able to be varied.

The first and second grinding heads in their operable configurations may be in a fixed position relative to each other.

The first and second grinding heads may be mountable to the body via a common arm.

The arm may be configured to articulate relative to the body. Preferably, the arm is pivotally connected to the body.

The positions of the first and second grinding heads relative to the body may be variable (preferably infinitely variable) about an arc of at least 60°, preferably at least 90°. In an embodiment, the positions of the first and second grinding heads relative to the body may be variable about an arc of 180°.

The first and second grinding heads may be mountable to the body such that they can be moved between a position to a first side of the body and a position to a second side of the body.

The first and second grinding heads may be spaced apart.

The first and second grinding heads may be positionable relative to the body so that in use the floor portions ground by the grinding heads at least partially overlap. In an embodiment, the first and second grinding heads may be positionable relative to the body so that in use the floor portions ground by the grinding heads substantially overlap, more preferably completely overlap.

The first and second grinding heads may be mountable to the body whereby the fraction of the floor portions that overlap is able to be varied.

The travelling mechanism defines a direction of movement of the apparatus in use. Preferably, the grinding heads are positionable with one grinding head in front of the other in the direction of movement of the apparatus.

The apparatus may be configured so that the position of the grinding heads relative to the body is variable during operation of the apparatus.

The apparatus may also comprise a lock for locking the grinding heads in position relative to the body.

Each grinding head may adjustable between its operable configuration and a raised non-operable configuration, preferably independently of each other.

Each grinding head may have a separate drive mechanism.

Each grinding head may be detachable from the body.

The travelling mechanism may comprise at least two wheels and may have a separate drive from the grinding heads.

Each grinding head may comprise three grinding tools. Although in other embodiments, each grinding head may have more or less grinding tools.

The apparatus may comprise a handle mounted to the body for a user to guide movement of the apparatus.

BRIEF DESCRIPTION OF THE DRAWINGS

Embodiments of the disclosure will now be described with reference to the accompanying drawings, in which.

DETAILED DESCRIPTION OF EMBODIMENTS

Figure 1:
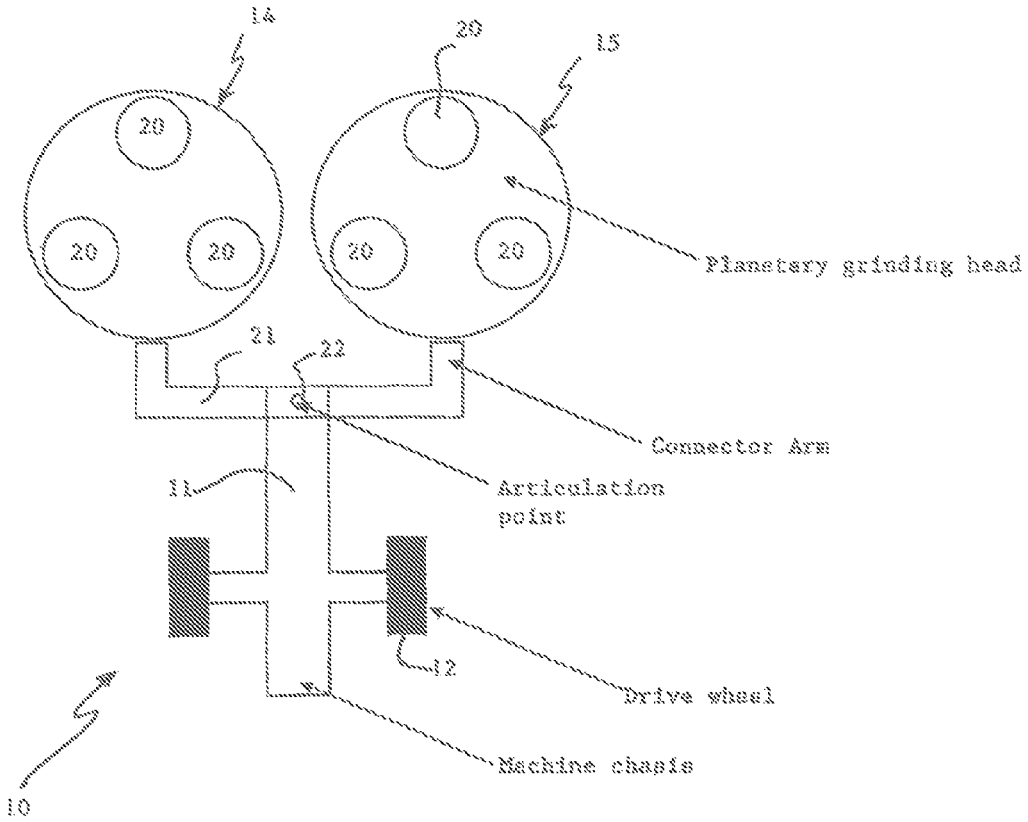
FIGS. 1-6 are schematic views of the underside of a grinding apparatus according to an embodiment of disclosure in various arrangements.
Figure 2:
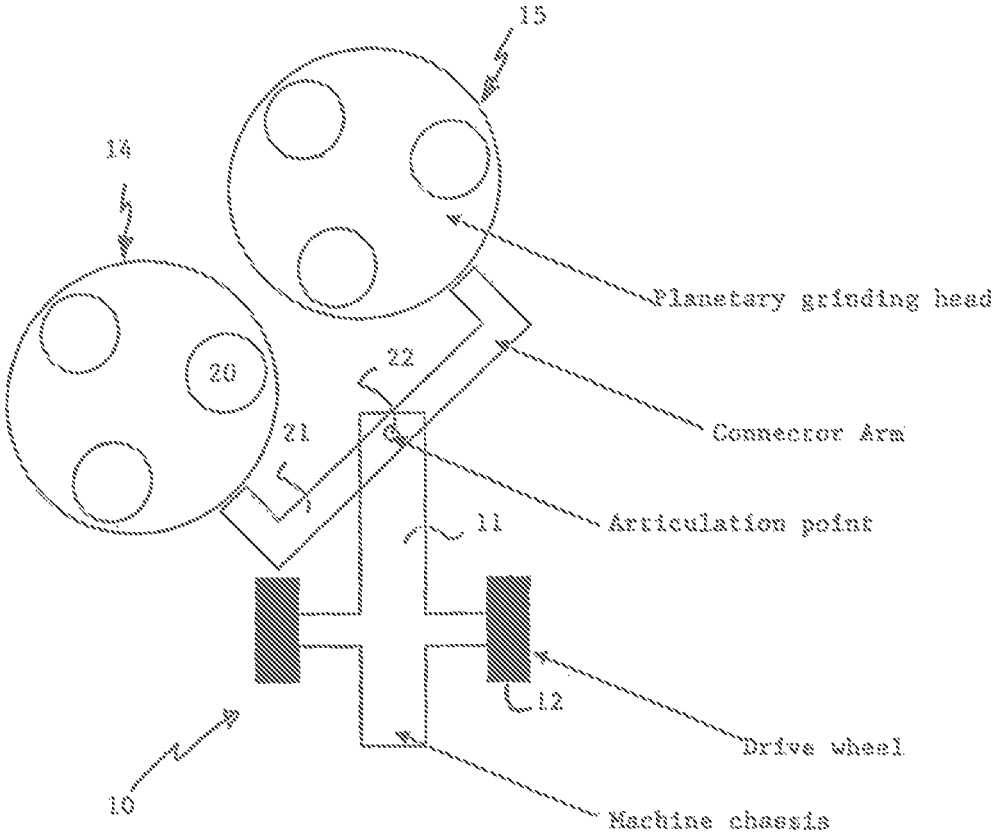
Figure 3:
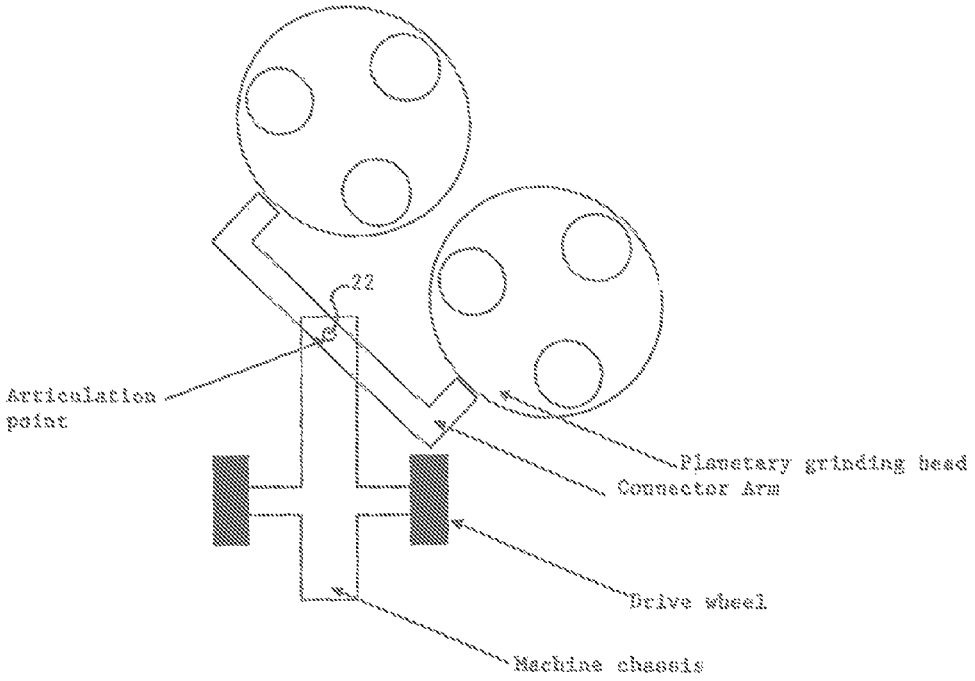

Referring to the Figures, a grinding apparatus 10 for grinding a floor according to an embodiment of the disclosure is shown. The apparatus 10 is especially designed for grinding and polishing concrete floors, but it is to be appreciated that the apparatus could also be used for grinding other hard surfaces such as wooden floors.

The apparatus comprises a body or chassis 11 to which are mounted wheels 12 to enable the body to travel across a floor during use of the apparatus. Of course it is to be understood that other travelling mechanisms may be employed such as skids but are less preferred to wheels. At least one of the wheels 12 is connected to a drive motor, although in other embodiments there is no wheel drive and the apparatus is moved solely by the force applied by the user. A handle (not shown) is connected to the body 11 which the user grips to guide and/or move the apparatus 10.

The apparatus 10 also comprises a first grinding head 14 and a second grinding head 15 mountable to the body 11. It is to be appreciated that the apparatus, in other embodiments, could have more grinding heads. The use of multiple grinding heads enables the apparatus 10 to cover a greater surface area and thereby increase the speed at which a floor surface, especially a very large floor surface can be ground and polished. Each grinding head 14, 15 incorporates three rotating grinding tools in the form of grinding discs 20 although they may have more or less such grinding tools.

Such grinding heads are sometimes referred to as 'planetary grinding heads' as the grinding tools 20 are mounted on a plate or ring that rotates in addition to the rotating tools. Each grinding head 14, 15 has a separate driving mechanism (that is separate from the drive mechanism for the wheels 12 and separate from each other) that rotates the grinding tools 20 and the plate or ring to which they are mounted.

In their operable position, the grinding heads 14, 15 are lowered so that grinding tools 20 engage the floor surface. However, the grinding heads 14, 15 may be raised, preferably independently of each other, to provide easy access to the grinding tools 20 for cleaning, maintenance and/or replacement.

The first and second grinding heads 14, 15 are mountable to the body 11 in a manner that enables the position of the first and second grinding heads relative to the body to be varied. In the embodiment shown in the Figures this is achieved by connecting the heads 14, 15 to a common mounting arm 21 that articulates with respect to the body 11 via a pivot mounting 22 to the body. The apparatus may be provided with a lock to lock the mounting arms and hence the first and second grinding heads in any particular configuration. Because the heads are connected to a common mounting arm, they remain in a fixed spaced apart relationship with one another. However, the pivotable mounting arm enables the heads to swing from side to side of the body through an arc of at least 60°, but preferably at least 90°, most preferably up to 180°. Although the apparatus could be designed so that the grinding heads can only be positioned in a number of discrete configurations relative to the body, preferably the positioning of the grinding heads relative to the body is infinitely variable about the arc defined by the pivoting arm 21. One advantage of this variable mounting is that it enables the grinding heads 14, 15 to be used in narrower and more confined spaces such as corners where prior multi head grinders could not. The positioning of the grinding heads 14, 15 relative to the body 11 may be varied while the grinding heads 14, 15 are operating so that there is no need to stop grinding while changing this positioning.

Figure 4:
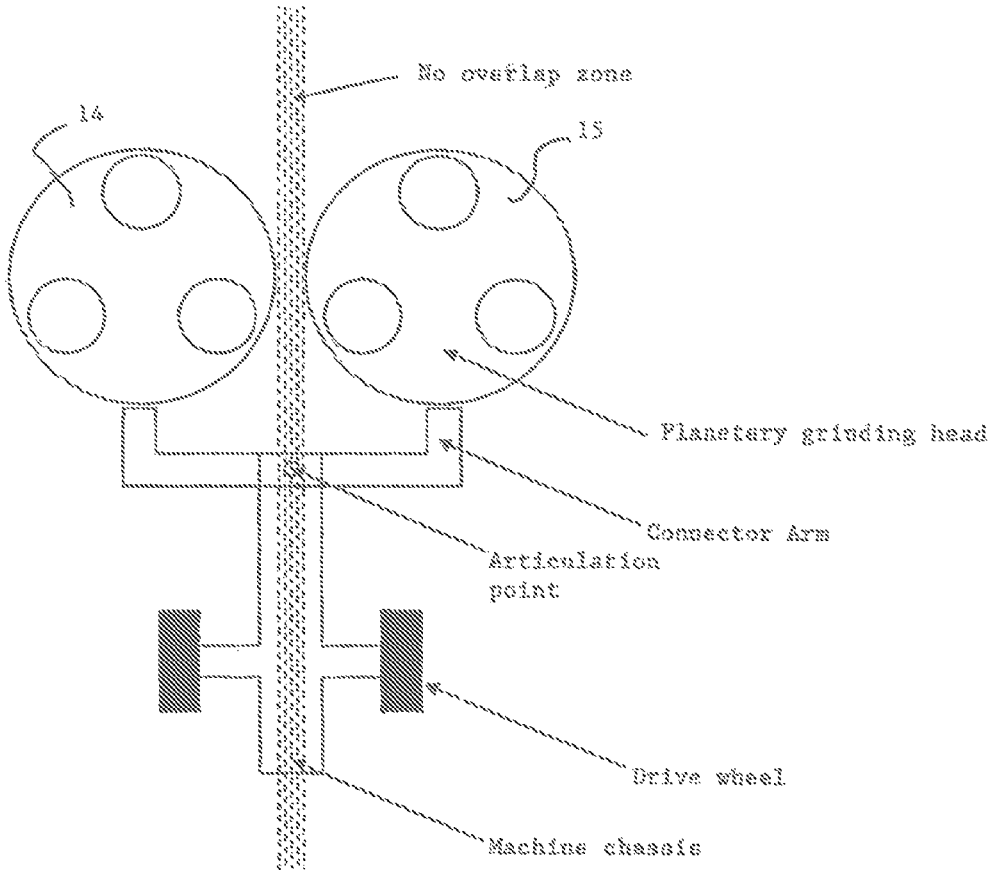
Figure 5:
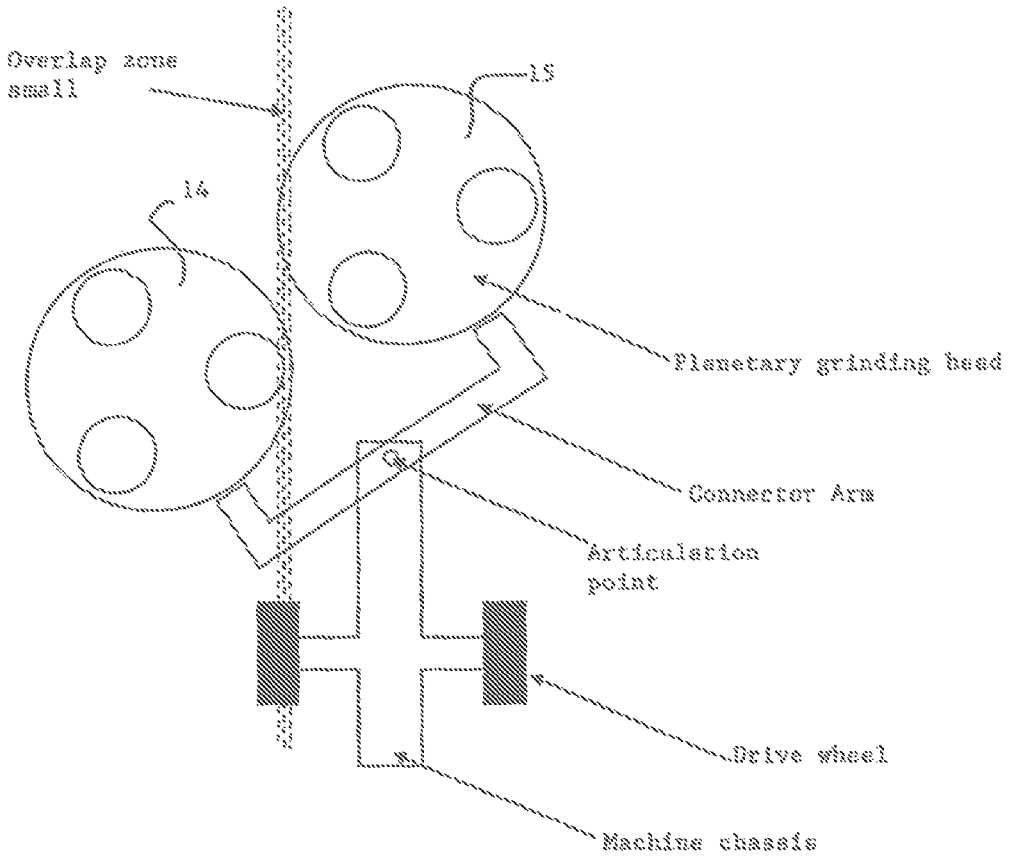
Figure 6:
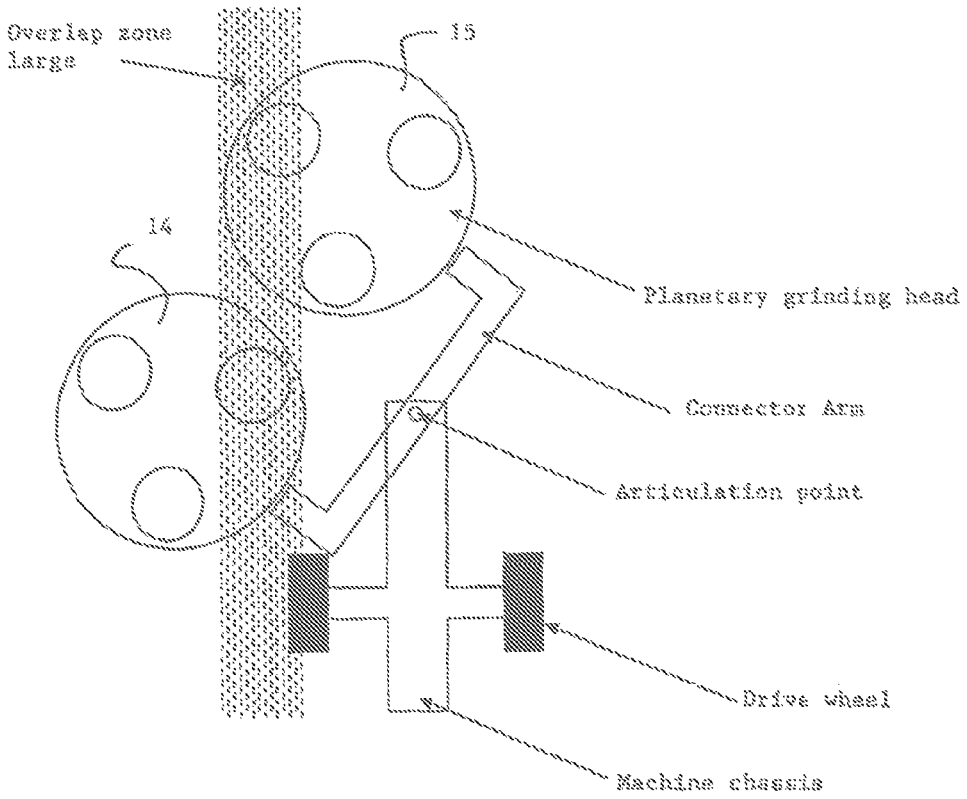

Another advantage of the variable mounting is shown in FIGS. 4-6, which demonstrate different configurations of the grinding heads 14, 15 with respect to the body. During operation of the grinding apparatus 10, the first grinding head 14 grinds a first floor portion and the second grinding head 15 grinds a second floor portion. As shown in FIGS. 4-6, the mounting arm 21 can be used to adjust the positioning of the grinding heads 14, 15 so that the first head 14 is positioned in front of the second head 15 in the direction that the apparatus is travelling with the result that the first and second floor portions ground by the heads overlap. The amount that the first and second floor portions overlap can be varied (see FIGS. 5 and 6) with the variation in the positioning of the grinding heads 14, 15. Advantageously, this enables the operator to readily adjust the amount and intensity of grinding that is carried out on a floor surface or portion of the floor surface based on the condition, hardness and other properties of the floor. Furthermore the operator can use the same apparatus to grind floors in different condition or of different properties and does not need to have multiple apparatuses or carry out multiple passes across a floor with the same apparatus.

In embodiments where the pivotable mounting arm enables the heads to pivot through an arc of 180°, the grinding heads 14, 15 may be positioned one directly in front of the other so that first and second floor portions ground by the respective grinding heads completely overlap. This can be used to provide an even higher intensity of grinding. In other embodiments where a two stage grinding process at different conditions is required to be performed, by positioning the heads one directly in front of the other, the two stage grinding process can be carried out in a single pass over the floor. For example, where a floor requires first a coarse grind followed by a finer, polishing grind, the first leading grinding head can incorporate coarse grit grinding tools and the second trailing head can incorporate finer grit grinding tools.

In other embodiments, the first and second grinding heads could be mounted to the body of the apparatus by mechanisms other than a common mounting arm which enable the position of the first and second grinding heads relative to the body to be varied. For example, each grinding head could be mounted to the body via separate mounting arms, which would give the apparatus an additional degree of freedom because the grinding heads would not be in a fixed relationship with each other. Alternatively, the body may be provided with multiple attachment points for mounting the grinding heads to, or the grinding heads may be mounted on sliding rather than pivoting arms.

Each of the grinding heads 14, 15 is separately mountable to and is readily detachable from the mounting arm 21. In addition, as described above, each grinding head is provided with separate drive mechanism. This means that each of the grinding heads can be removed from the apparatus 10 and the apparatus is able to continue to be operated. This is especially advantageous should one of the grinding heads break down or require maintenance and in this situation would enable the operator to continue the grinding task with or without replacing the inoperable grinding head. Furthermore, it enables the operator to quickly disassemble the apparatus by removing the grinding heads, thus making the apparatus smaller and able to fit through a doorway for example that prior multi head grinders could not. Once the apparatus was past the doorway it could be reassembled and the grinding operation commenced. Additionally, the apparatus can thus also incorporate any conventional grinding head that has a separate drive mechanism making it more flexible and easier to use.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A grinding apparatus for grinding a floor, the apparatus comprising:

a body having a travelling mechanism which travels the body across a floor whilst the apparatus is grinding;

a first grinding head incorporating at least one grinding tool and having an operable configuration in which the first grinding head grinds a first floor portion; and a second grinding head incorporating at least one grinding tool and having an operable configuration in which the second grinding head grinds a second floor portion;

wherein the first and second grinding heads are mounted to the body spaced apart with respect to each other, and the first grinding and second grinding heads are mounted to respective first and second distal ends of a mounting arm, and wherein the first and second grinding heads are mounted whereby their positions relative to the body are variable such that the first and second grinding heads are moved between a position to a first side of the body and a position to a second side of the body, and wherein each grinding head is adjustable between its operable configuration and a raised non-operable configuration independently of the other grinding head.

2. A grinding apparatus as claimed in claim 1, wherein the first and second grinding heads in their operable configurations are in a fixed position relative to each other.

3. A grinding apparatus as claimed in claim 1, wherein the first and second grinding heads are mountable to the body via a common arm.

4. A grinding apparatus as claimed in claim 3, wherein the arm is configured to articulate relative to the body.

5. A grinding apparatus as claimed in claim 3, wherein the arm is pivotally connected to the body.

6. A grinding apparatus as claimed in claim 1, wherein the positions of the first and second grinding heads relative to the body are variable about an arc of at least 60°.

7. A grinding apparatus as claimed in claim 6, wherein the positions of the first and second grinding heads relative to the body are infinitely variable.

8. A grinding apparatus as claimed in claim 1, wherein the first and second grinding heads are positionable relative to the body so that in use the floor portions ground by the grinding heads at least partially overlap.

9. A grinding apparatus as claimed in claim 8 wherein the first and second grinding heads are mountable to the body whereby the fraction of the floor portions that overlap is able to be varied.

10. A grinding apparatus as claimed in claim 1, wherein the travelling mechanism defines a direction of movement of the apparatus in use, the grinding heads being positionable with one grinding head in front of the other in the direction of movement of the apparatus.

11. A grinding apparatus as claimed in claim 1, wherein the apparatus is configured so that the position of the grinding heads relative to the body is variable during operation of the apparatus.

12. A grinding apparatus as claimed in claim 1, wherein the apparatus also comprises a lock for locking the grinding heads in position relative to the body.

13. A grinding apparatus as claimed in claim 1, wherein each grinding head has a separate drive mechanism.

14. A grinding apparatus as claimed in claim 1, wherein each grinding head is readily detachable from the body.

15. A grinding apparatus as claimed in claim 1, wherein the travelling mechanism comprises at least two wheels.

16. A grinding apparatus as claimed in claim 1, wherein the travelling mechanism has a separate drive from the grinding heads.

17. A grinding apparatus as claimed in claim 1, wherein each grinding head comprises three grinding tools.

18. A grinding apparatus as claimed in claim 1, wherein the apparatus comprises a handle mounted to the body for a user to guide movement of the apparatus.

19. A grinding apparatus as claimed in claim 1, wherein the mounting arm comprises a first portion and first and second distal portions each extending angularly from a distal end of the first portion.

* * * * *